United States Patent [19]

Reinhardt et al.

[11] 4,188,934

[45] Feb. 19, 1980

[54] STEP SAFETY GROOVER APPARATUS

[75] Inventors: Frederick N. Reinhardt; William A. Fouts, both of Gardena, Calif.

[73] Assignee: Cushion Cut, Inc., Harbor City, Calif.

[21] Appl. No.: 953,068

[22] Filed: Oct. 20, 1978

[51] Int. Cl.[2] ..... B28D 1/18

[52] U.S. Cl. ..... 125/4; 125/13 R; 51/170 PT; 30/373

[58] Field of Search ..... 30/373, 374, 375; 144/136 D, 136 B; 125/13 R, 14, 15, 39, 4; 51/170 PT, 176

[56] References Cited

U.S. PATENT DOCUMENTS

| | | | |
|---|---|---|---|
| 1,404,342 | 1/1922 | Clarke | 51/176 |
| 1,845,666 | 2/1932 | Jennings | 125/4 |
| 2,487,277 | 11/1949 | Siftar | 125/14 |
| 2,709,878 | 6/1955 | Olson | 125/13 R |
| 3,722,496 | 3/1973 | Schuman | 125/13 R |

FOREIGN PATENT DOCUMENTS

| | | | |
|---|---|---|---|
| 643649 | 4/1937 | Fed. Rep. of Germany | 30/373 |
| 962371 | 6/1950 | France | 125/4 |

*Primary Examiner*—Harold D. Whitehead

*Attorney, Agent, or Firm*—Nilsson, Robbins, Dalgarn, Berliner, Carson & Wurst

[57] ABSTRACT

A step groover apparatus has a housing to which a direct drive means is attached. The drive means has a rotatable shaft extending into the interior of the housing and on which a plurality of grooving blades are fixed in space relationship. The blades extend through an opening in a lower portion of the housing. The housing has front and rear skids on which the apparatus slides as it moves along the top of the step. The skids are vertically adjustable to vary the depth of the groove to be cut in the step. A vertically and horizontally adjustable face guide is adapted to be forced against the face of the step so that the grooves will be parallel to the step face. A radially extending handle is attached to the housing so that the rear skid may be pressed downward against the top of the step. A laterally extending handle is attached to the housing so that the front skid and the face guide may be simultaneously pressed against the top and face of the step, respectively. Cooling apparatus is also provided to extend through the housing to spray the blades with water and provide lubrication between the skids and the step.

7 Claims, 3 Drawing Figures

FIG. 1
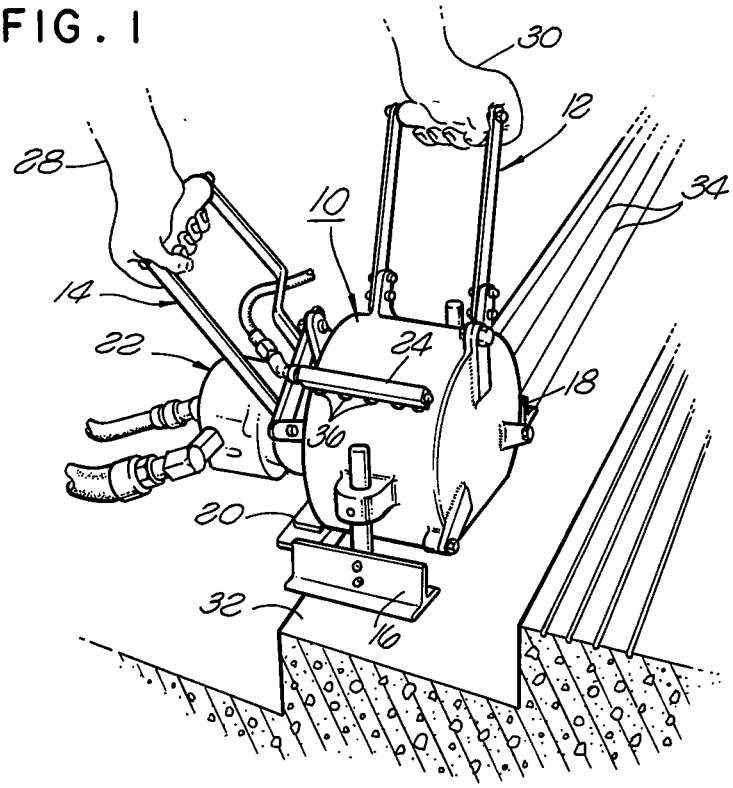
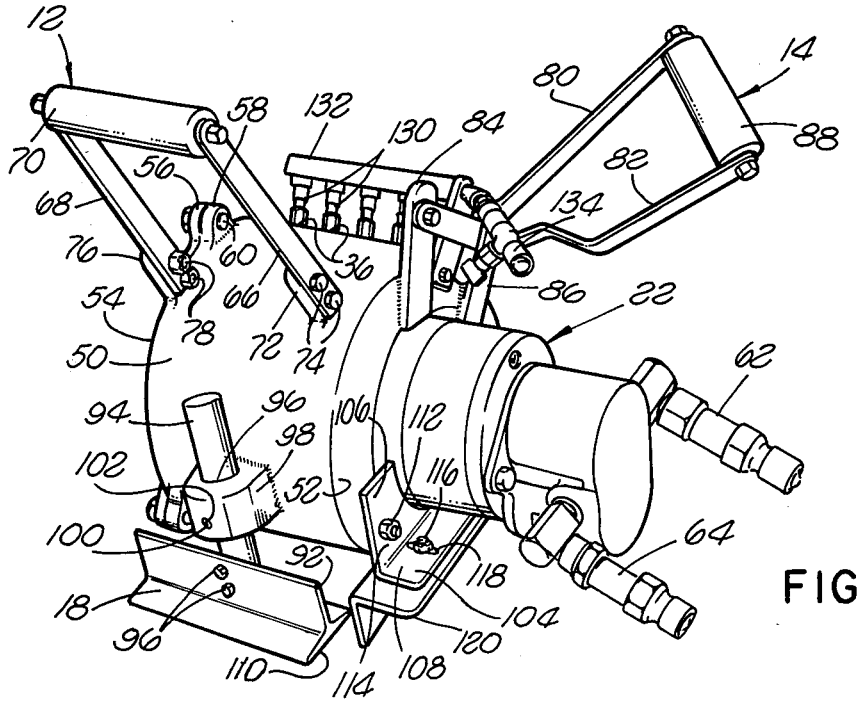
FIG. 2

STEP SAFETY GROOVER APPARATUS

BACKGROUND OF THE INVENTION

The present invention relates to cutting apparatus and, in particular, to apparatus for cutting grooves in the top of stair steps to provide a slip-resistant top surface on the stair step.

Various grooving machines for cutting grooves in the tops of stair steps are known. For example, in U.S. Pat. No. 1,845,666, issued Feb. 16, 1932, to Jennings, a stair tread grooving machine is shown including a housing in which a plurality of grooving blades are coupled to an axle which is positioned between two bearing members fixed to the housing. The apparatus provides wheels so that the entire stair tread grooving machine can be rolled along the top of a stair step as the cutting process proceeds. A motor is placed on top of the housing and provides rotational motion to the grooving blades via a pulley and belt apparatus. The positioning means are vertically and horizontally adjustable. However, the method by which this adjustment takes place requires complex support, bearing and housing apparatus. Furthermore, this apparatus does not require any blade cooling apparatus and, consequently, no cooling means is incorporated. Without liquid cooling means, such as that in the present invention, substantial quantities of dust are produced which constitute a potential health hazard to the operator. To partially overcome this deficiency, the apparatus includes a vacuum system to collect the dust. Such apparatus is not required in the present invention. Finally, no means is provided for maintaining the face guide against the front face of the step to insure that the grooves will be cut parallel to the face of the step.

A similar grooving machine apparatus was disclosed in U.S. Pat. No. 2,709,878, issued June 7, 1955, to Olson. The principal difference in Olson when compared to Jennings discussed above is in the means by which the cutting blades are adjusted upwardly or downwardly to cut deeper or shallower grooves in the top of the stair step. Thus, in Olson, an upper telescoping housing supports the motor while a lower telescoping housing supports the blades as associated bearings and support apparatus. The lower and upper telescoping housings are movable relative to one another to lower or raise the blades. Clearly, Olson involves even more complexity without really solving any of the problems in the Jennings patent.

In yet another patent, U.S. Pat. No. 3,464,737, issued Sept. 2, 1969, to Haase, et al, a road grooving machine is shown having diamond cutting blades which utilize liquid coolant, such as water, which is sprayed from a plurality of nozzles onto the blades to cool them during the grooving process.

In each of the above patents, the drive means includes not only the motor but also requires a substantial amount of linkage, including pulleys and belts, between the axle of the drive motor and the grinding axle. None of the above inventions provide direct drive. Furthermore, as previously mentioned, each of the above grooving apparatus incorporates wheels by which the grooving apparatus is rolled along the surface to be grooved. However, the inclusion of wheels substantially increases the complexity of the apparatus required to raise or lower the cutting blades so that a particular depth of groove can be selected.

The reason that these patents generally incorporated wheels is believed to be because it was felt that a substantial amount of weight was required to press the cutting blades against the surface to be grooved. Without the incorporation of wheels, the increased friction caused by the required downward force would cause the above devices to be very difficult to move along the step as the grooving took place. The grit resulting from the grooving added to this problem and caused even more friction and made use of wheels even more necessary. The utilization of a simple, lightweight, portable grooving apparatus without wheels and the associated complex apparatus, where the downward force applied to force the grooving blades into the step surface is provided by the operator, was apparently not contemplated in any of the above inventions. Rather, the downward force was largely a result of the weight of the motor and other apparatus placed directly above the blades. Of course, such arrangement required linkages between the motors and the blades. Furthermore, none of the above inventions provided for any component of force to be applied by the operator to press the face guide against the front face of a stair step to insure that the grooves were, in fact, parallel to the front face of the stairs. Indeed, with the stair step grooving apparatus patents discussed above, it is possible for the grooves to be cut at a slant relative to the front face of the stair if initial alignment is incorrect. In such a case, the direction of the grooves being cut is determined not by the face guide but rather by the blades as directed and positioned in the just cut grooves. This result would occur because the blades tend to follow the grooves cut in a longitudinal fashion so that the initial direction of cut would be maintained. The use of wheels further enforces this tendency to maintain misalignment.

By contrast, the present invention overcomes these problems and deficiencies by providing a novel stair grooving apparatus which includes a radially attached handle whereby an operator can press directly downward on the apparatus to press the rear skid against the top surface to be grooved and a second, laterally extending handle which is positioned in such a way that, as the operator presses downward on the second handle, a vertical as well as a horizontal force is simultaneously applied to cause the front skid of the present invention to press against the top surface at the same time that the face guide member is pressed against the face of the stair step being grooved. In addition, much of the complexity of the prior step grooving apparatus is eliminated since the present invention does not utilize wheels, but rather utilizes skids.

Skids have a significant advantage over wheels in that skids do not tend to maintain a particular direction. Thus, if an incorrect direction in the grooving occurs, correction of that misdirection is more easily achieved in that the skids do not tend to inhibit the change of direction as wheels generally do. Furthermore, the utilization of skids rather than wheels permits less lateral force to be applied to position the face guide against the face of the stair step. Finally, and most obviously, the utilization of skids rather than wheels allows a greatly simplified height adjustment mechanism to be incorporated which not only reduces the complexity of the raising and lowering mechanism, but also greatly decreases the weight of the groove cutting apparatus.

In addition to the above advantages, the present invention incorporates a liquid cooling system whereby a plurality of orifices are provided in the housing with a plurality of nozzles provided, one for each orifice. The plurality of nozzles are then coupled via coupling apparatus to a source of cooling fluid which is sprayed by the nozzles against the cutting or grooving blades to cool the blades.

While the use of the fluid is primarily for the purpose of cooling, the utilization of a fluid has a significant secondary purpose, namely, to provide a lubricant to decrease the friction between the skids and the surface of the stair step to be cut. The fine grit obtained as the concrete or other material from which the step is made is cut provides additional lubrication effect when it is wetted by the fluid. Thus, the fine grit plus the presence of the fluid allows the skids to slide much more freely across the top surface of the stair step than would be possible without the fluid.

Finally, the utilization of liquid cooling also has another secondary effect, namely, suppressing dust and other pollutants which can be hazardous to the health of the operator. Even though the Haase, et al patent described above incorporates a liquid cooling system which has the secondary effect of suppressing dust, because the Haase, et al patent utilizes wheels, the liquid does not act as a lubricant to assist in moving the apparatus along the surface to be grooved. By contrast, the present invention utilizes the liquid and the resulting dust and small particles from the grinding to provide lubrication between the step and the skids to thereby assist in moving the apparatus more easily along the stair step.

It will be appreciated that, without the liquid and fine grit as a lubricant on top of the stair step, the incorporation of skids instead of wheels on either of the two patents discussed above would have been impractical since it would be very difficult to move the machine along the top of the stair as the necessary downward force was applied.

SUMMARY OF THE INVENTION

A stair grooving apparatus is provided for cutting longitudinal grooves along the top of a stair step parallel to the front face of that stair step comprising a housing which itself comprises a peripheral member having a first end and a second end. The peripheral member is provided with an opening through one portion thereof and further incorporates a plurality of housing orifices through a second portion thereof. A first end plate is fixed to the first end of the peripheral member and a second plate is removably attached to the second end of the peripheral member so that the peripheral member and the end plates define an interior region of the housing. A drive means is axially mounted to the first end plate where the drive means has a rotatable shaft which extends through an orifice in the first end plate. A grooving means comprises a plurality of grooving blades which are attached to the shaft in the interior region of the housing with a portion of the blades extending through the opening in the peripheral member of the housing. In addition, the cutting blades are positioned in spaced relationship to one another to provide spacing between the grooves which are cut in the stair step using the above apparatus.

A positioning means is also provided including a front skid which is vertically adjustable and mounted to a front region of the housing. A rear skid is also vertically mounted to the rear region of the housing and is adjustable as well. The front and rear skids are thus adapted for supporting the stair grooving apparatus on top of the stair step with the opening in the peripheral member adapted for being positioned immediately above the stair step top surface. The positioning means also includes a face guide means which is connected to the housing and is adapted for being positioned next to the vertical face of the stair step for guiding the stair grooving apparatus.

In order to press the step grooving apparatus against the top of the stair step and against the front face of the stair step, a grasping means is provided which comprises a radially extending handle attached to the housing for pressing a selected one of the front and rear skids against the top of the stair step when a downward force is applied to the radially extending handle and further includes a laterally extending handle attached to the housing for simultaneously pressing the other of the front and rear skids against the top of the stair step and the face guide against the face of the stair step.

Finally, the present apparatus incorporates a liquid application means which comprises a plurality of nozzles attached to the housing, each of the nozzles positioned for directing a liquid through the housing orifices for spraying the liquid onto the grooving means and onto the step.

In operation, it is preferable that the direction of the blade drive be against the direction along which the apparatus is moved to prevent the grooving blades from climbing out of the grooves.

BRIEF DESCRIPTION OF THE DRAWINGS

The present invention will be better understood from the detail description below taken in conjunction with the drawings wherein like reference characters refer to like parts throughout and in which:

FIG. 1 is a pictorial view illustrating the present invention in use by an operator;

FIG. 2 is a more detailed pictorial top view of the step groover apparatus of the present invention.

DETAIL DESCRIPTION

Figure 3:
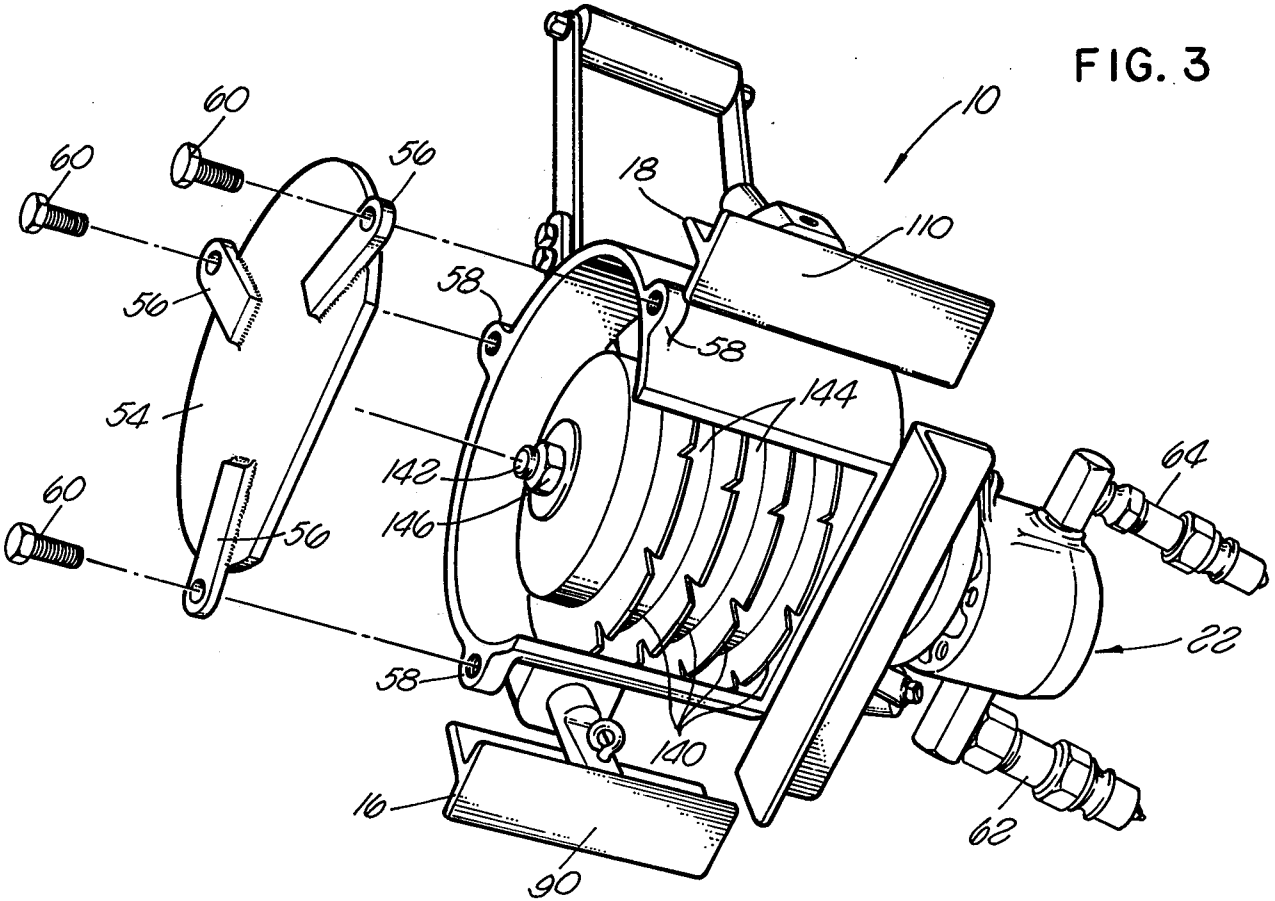
FIG. 3 is an exploded pictorial view of the bottom of the groove cutting apparatus of the present invention.

A step groover apparatus in accordance with the present invention is illustrated in FIG. 1 having a cylindrical housing (peripheral member) 10 to which is fixed a radially extending handle assembly 12 and a laterally extending handle assembly 14. The housing is supported on the top surface of a stair step by a front skid 16 and rear skid 18, each of which is adjustably attached to the housing 10. Also coupled to the housing 10 along one side is a face guide means 20 which is adapted to extend below the top of a stair step and against the face of the stair step to provide a means of guiding the step grooving apparatus.

Grooving blades and spacers (see FIG. 3) are positioned on a shaft in the interior of the housing 10 and are rotated in response to a drive means which, in the illustrative embodiment shown in FIG. 1, is an air drive motor 22.

In operation, the drive motor 22 causes the shaft and thus the circular blades in the interior of the housing 10 to rotate rapidly. An operator grasps the lateral handle assembly 14 with his right hand 28 thereby forcing the front skid 16 against the top surface 32 of a stair step while simultaneously causing the portion of the face guide means extending below the top surface 32 of the stair step against the face 34 of the stair step 32. Simultaneously, the operator grasps the radially extending handle assembly 12 with his left hand 30 pressing directly downward thereby causing the read skid 18 to be pressed against the top surface 32 of the stair step. In order to create a plurality of parallel grooves 34 in the top surface 32 of the stair step, the circular rotating cutting blades 140 (see FIG. 3) extend below the imaginary plane connecting the lowermost portion of the front skid 16 and the lowermost portion of the rear skid 18 which, in operation, are pressed against the top 32 of the stair step.

In order to provide cooling for the blades in the interior of the housing 10 and lubrication for the apparatus between the skids and the step surface, a nozzle assembly 24 is provided to spray water on the blades in the interior of the housing 10 through a plurality of orifices 36 through the housing 10.

Referring to FIG. 2, additional details of the preferred embodiment of the present invention are shown. Thus, the housing comprises a cylindrical housing member 50 with a fixed end plate 52 and a removable end plate 54.

Referring to FIG. 3, the removable end plate 54 is shown with three end plate connecting flanges 56 equiangularly positioned and welded to the outside surface of the removable end plate 54. Three corresponding housing flanges 58 with an inside threaded orifice are attached, for example, by welding, around the outside surface of the cylindrical housing member 50. The removable end plate 54 may then be attached to the end of the cylindrical housing member 50 by aligning the end plate connecting flanges 56 with the corresponding housing flanges 58 and then utilizing a connecting bolt 60 to pass through an unthreaded orifice in the end of each interplate connecting flange 56 and screwing the connecting bolts 60 into the inside threaded orifice of the housing flange 58.

Referring again to FIG. 2, the compressed air drive means 22 is shown having an input air fitting assembly 62 for receiving the compressed air to drive the compressed air drive means 22 and an exit air fitting assembly 64 through which the compressed air exits from the compressed air drive means 22. Of course, it will be appreciated that any drive means may be utilized, including an electrical or hydraulic motor or any other drive means well known in the art. However, it is preferable in order to provide a compact and portable step groover apparatus that the drive means be attached to directly drive the grooving blades to thereby eliminate drive linkages, such as the belts and pulleys incorporated in the prior art patents discussed previously.

The particular grasping means by which the operator presses the step groover apparatus against the top and front face of a stair step comprises, first, the radially extending handle assembly 12 which comprises a pair of radial connecting bars 66 and 68 between which is positioned a radial handle grip 70 between the outermost ends of the respective radial connecting bars 66 and 68. The radial connecting bar 66 is attached to a radial handle connecting flange 72, which is welded to the outside surface of the cylindrical housing member 50, by a pair of bolts and nut assemblies 74. Similarly, the radial connecting bar 68 is attached to a second radial handle connecting flange 76, also welded to the surface of the cylindrical housing member 50, by a second pair of bolt and nut assemblies 78.

In a similar fashion, the laterally extending handle assembly 14 has a pair of lateral connecting bars 80 and 82 which are respectively coupled by appropriate rigid linkage to lateral handle connecting flanges 84 and 86 which, in the embodiment illustrated in FIG. 2, are welded to the fixed end plate 52. A lateral handle grip 88 is connected between the remote ends of the lateral connecting bars 80 and 82.

Referring to FIG. 2 in conjunction with FIG. 3, positioning means are provided including the front skid 16 which may be a T-bar having a cross member 90, the bottom surface of which is adapted to be positioned in operation against the top surface of the stair step to be grooved.

In a similar fashion, a rear skid 18 is also vertically adjustable relative to the housing 10 and also comprises a T-bar configuration where the lower surface 110 of the cross member is adapted for being placed against the top surface of the stair step to be grooved.

The means by which the front skid 16 and the rear skid 18 may be adjustable relative to the housing 10 may be described by reference just to the rear skid 18. It will be appreciated, of course, that the adjustment mechanisms for the front skid is exactly analogous. Thus, the T-bar configuration of the rear skid 18 has a vertical member 92 connected to the cross member 110. The vertical member 92 is rigidly fixed to a shaft or rod 94 by a pair of connecting bolts 96 which pass through the vertical member 92 of the T member configuration of the skid 18. The shaft 94 extends through an orifice 96 in a rear support flange 98 which is welded to the surface of the cylindrical housing member 50. In order to prevent the shaft 94 from sliding in the orifice 96 of the rear support flange 98, a set screw 100 is provided in an inside threaded orifice 102 through the rear support flange.

By appropriately loosening the set screw in the rear skid support flange and in a front skid support flange, the front skid 16 and the rear skid 18 may be adjusted vertically to define the depth of cut which the grooving blades make into the top surface of the stair step.

Parallel alignment between the grooves cut by the step groover apparatus and the front face of the step into which the grooves are being cut may be maintained by the face guide means 20. By way of illustration, in FIG. 2, the face guide means may comprise an L-shaped connecting flange 104 having a vertical portion 106 and a horizontal portion 108. The vertical portion 106 of the L-shaped connecting flange 104 may be adjustably bolted to the fixed end plate 52 by a bolt 112 which extends through a vertical slot 114 in the vertical member 106. Thus, by loosening the bolt 112 and a similar bolt (not shown) on the opposite end of the vertical member 106, the face guide 20 may be adjusted vertically. In a similar manner, the face guide means 20 may be adjusted horizontally, thereby defining the positioning of the grooves to be cut, by a second adjustment bolt 116 which passes through a slot 118 in the horizontal portion 108 of the L-shaped connecting flange 104. A similar bolt (not shown) is attached at the other end of the L-shaped connecting flange horizontal member 108. By loosening the bolts 116, a face guide member 120 may be adjusted horizontally.

The step groover apparatus of the present invention may also include a liquid cooling and lubricating means for spraying a liquid coolant onto the blades in the interior of the housing and providing lubrication between the skids and the step surface. For example, the cooling means may comprise a plurality of nozzles 130 which are connected to extend through a plurality of orifices 36 in the cylindrical housing member 50. Fluid is then supplied to each of the nozzles through a pipe 132 which may be coupled to a hose through a fitting 134. In the preferred embodiment, the coolant-lubricant liquid is water.

Referring now to FIG. 3, an exploded bottom view of the step groover apparatus of the present invention is illustrated with the removable end plate 54 disconnected. As illustrated, the grooving blades 140 are attached to the shaft 142 of the drive means 22. Between each of the grooving blades 140 is at least one spacer 144. Thus, the spacing between the grooves to be cut in the top of each stair step may be varied by varying the amount of spacing between the respective grooving blades. In addition, in the preferred embodiment, the grooving blades are diamond blades.

The blades are attached to the shaft by a nut 146 which is fixed to the end of the shaft 142. Of course, it is preferable that the spacers and blades be immovable relative to the shaft so that no slipping occurs when the shaft is rotating. Such immobility may be provided by simply tightening the nut 146 on the end of the shaft 142 or by a key groove in the shaft and a corresponding key groove in each of the blades with a key element placed in the respective aligned grooves. Of course, any other appropriate method may also be utilized without departing from the present invention.

In order for the blades to extend into the surface of a stair step to be cut, it will, of course, be appreciated that the blades must extend through at least a portion of the housing 10. Thus, the enclosed cylindrical housing defined by the cylindrical housing member 50 and the two end plates 52 and 54 is provided with a flat side with an opening in the flat side through which the grooving blades extend. In operation, when grooving is to take place, the flat side of the housing is placed adjacent but above the top surface of the stair step. In the preferred embodiment of the present invention, it will, of course, be appreciated that the end of the shaft 142 is spaced apart from the inside surface of the removable end plate 54.

Thus, there has been described a step groover apparatus which is lightweight and portable and greatly simplified over prior devices. Of course, it will be appreciated that various other arrangements are configurations of the various components of the present invention may be made without departing from the spirit of the present invention and that the invention as described in intended to be illustrative only and not limiting.

What is claimed is:

1. A stair grooving apparatus for cutting longitudinal grooves along the top of a stair step comprising:

a housing which comprises:

a peripheral member having a first end and a second end, the peripheral member having an opening through one portion thereof and a plurality of housing orifices through a second portion thereof, a first end plate fixed to the first end, the first end plate having an orifice therethrough, and a second end plate removably attached to the second end, the peripheral member and end plates defining an interior region;

an axially mounted drive means attached to the first end plate, the drive means having a rotatable shaft positioned to extend through the orifice in the first end plate;

grooving means which comprises:

a plurality of grooving blades attached to the shaft in the interior region of the housing, a portion of the blades extending through the opening in the peripheral member of the housing, the cutting blades positioned for being spaced apart from each other;

positioning means which comprises:

a front skid plate vertically adjustably mounted to a front region of the housing, a rear skid plate vertically adjustably mounted to a rear region of the housing, the front and rear skids adapted for supporting the stair grooving apparatus on the top of the stair step, with the opening in the peripheral member adapted for being positioned immediately above the stair step, and a face guide means connected to the housing for being positioned next to the vertical face of the stair step for guiding the stair grooving apparatus;

grasping means which comprises:

a radially extending handle attached to the housing for pressing a selected one of the front and rear skids against the top of the stair step when a downward force is applied to the radially extending handle, and a laterally extending handle attached to the housing for simultaneously pressing the other of the front and rear skids against the top of the stair step and the face guide against the face of the stair step; and means for cooling and lubricating which comprises a plurality of nozzles attached to the housing, each nozzle for directing a liquid through the housing orifices for spraying the liquid on the grooving means and on the stair step surface.

2. The stair grooving apparatus of claim 1 wherein the peripheral member of the housing is generally cylindrical having a flat side, the opening being through the flat side.

3. The stair grooving apparatus of claim 1 wherein the drive means is in a direct drive configuration.

4. The stair grooving apparatus of claim 1 wherein the end of the shaft is in the interior region and is spaced apart from the interior surface of the second end plate.

5. A stair grooving apparatus for cutting longitudinal grooves along the top of a stair step comprising:

a housing having an opening through one portion thereof and a plurality of orfices;

a direct drive means attached to the housing, the drive means having a rotatable shaft extending through the housing and terminating at an interior region of the housing;

a plurality of grooving means fixed to the shaft in the interior of the housing for being rotated by the shaft, the grooving means having a plurality of grooving portions extending through the opening in the housing for cutting into the top of a stair step;

positioning means which comprises:

a first skid plate attached to one end of the housing, a second skid plate attached to the opposite end of the housing from the one end, the first and second skids adapted for supporting the stair grooving apparatus on top of a stair step, and a face guide attached to the housing for being positioned next to the face of the stair step for guiding the stair grooving apparatus therealong;

grasping means which comprises:

a radially extending handle attached to the housing for pressing a selected one of the first and second skids against the top of the stair step when a downward force is applied to the radially extending handle, and a laterally extending handle attached to the housing for simultaneously pressing the other of the first and second skids against the top of the stair step and the face guide against the face of the stair step; and means for cooling and lubricating which comprises a plurality of nozzles attached to the housing, each nozzle for directing a liquid through the housing orifices for spraying the liquid on the grooving means and on the stair step surface.

6. The stair grooving apparatus of claim 5 wherein the housing comprises a cylindrical member with a flat side portion having, on its respective ends, a circular fixed end plate and a circular removably attached end plate, the end plates each having a flat end portion defined along a cord thereof, the cylindrical member, first and second end plates defining an enclosed cylindrical housing having a flat side, the opening being in the flat side.

7. The stair grooving apparatus of claim 6 wherein the end of the shaft is in the enclosed cylindrical housing and is spaced apart from the end plates of the housing.

* * * * *